US006629430B2

(12) United States Patent
Mills et al.

(10) Patent No.: US 6,629,430 B2
(45) Date of Patent: Oct. 7, 2003

(54) COOLER

(75) Inventors: David Mills, Winnipeg (CA); Claude Cormier, Winnipeg (CA); Glenn J. Bartlett, Winnipeg (CA)

(73) Assignee: Reliance Products Limited Partnership, Winnipeg (CA)

( * ) Notice: Subject to any disclaimer, the term of this patent is extended or adjusted under 35 U.S.C. 154(b) by 176 days.

(21) Appl. No.: 09/930,708

(22) Filed: Aug. 9, 2001

(65) Prior Publication Data

US 2003/0029187 A1 Feb. 13, 2003

(51) Int. Cl.[7] ..... F25D 3/08
(52) U.S. Cl. ..... 62/457.2; 62/457.3; 62/457.7
(58) Field of Search ..... 62/457.2, 457.3, 62/457.7

(56) References Cited

U.S. PATENT DOCUMENTS

| | | | | |
|---|---|---|---|---|
| 4,537,313 A | | 8/1985 | Workman | |
| 4,802,344 A | | 2/1989 | Livingston et al. | |
| 4,826,060 A | | 5/1989 | Hollingworth | |
| D328,550 S | | 8/1992 | Mogil et al. | |
| 5,353,607 A | * | 10/1994 | McBride | 62/291 |
| 5,403,095 A | | 4/1995 | Melk | |
| 5,447,256 A | | 9/1995 | Graham | |
| 5,472,279 A | | 12/1995 | Lin | |
| 5,490,396 A | | 2/1996 | Morris | |
| 5,570,588 A | * | 11/1996 | Lowe | 62/457.7 |
| 5,671,611 A | * | 9/1997 | Quigley | 62/371 |
| 6,068,402 A | * | 5/2000 | Freese et al. | 383/108 |
| 6,244,066 B1 | * | 6/2001 | LaRose | 220/560 |

* cited by examiner

*Primary Examiner*—William C. Doerrler
*Assistant Examiner*—Filip Zec
(74) *Attorney, Agent, or Firm*—Adrian D. Battison; Michael R. Williams; Ryan W. Dupuis

(57) ABSTRACT

A cooler comprising a container having a container bottom wall and upstanding side walls standing upwardly from a periphery of the bottom wall and defining an open top and a cover wall hingedly connected to one of the side walls and attachable to at least one other of the side walls so as to close the open top. Each of the side walls and the cover wall being formed of a flexible fabric material with a layer of insulating material thereon such that the side walls can be folded to allow collapse of the container from an expanded position for receiving articles to be maintained cooled to a collapsed storage condition. A bottle for receiving liquid has two opposed side walls and a peripheral wall with one side wall shaped to substantially match the shape of the bottom wall such that the bottle is arranged to be located at the bottom of the container with the side wall lying against the bottom wall to provide stiffening for the bottom wall and the other side wall facing into the interior of the container. The bottle has a bottle neck extending through the peripheral wall through which the liquid can be poured into and discharged from the bottle and a closure cap covering the bottle neck. The bottle neck and the closure cap being arranged so as to be accessible at one side wall of the container for discharge of the liquid.

18 Claims, 3 Drawing Sheets

COOLER

FIELD OF THE INVENTION

The present invention relates to a cooler, more particularly a cooler having a bottle from which liquid can be poured.

BACKGROUND

Conventional coolers have an openable rigidly shelled insulated container which is arranged to receive goods. These goods are kept cool or maintained cool by the addition of ice or frozen gel pack. Rigid coolers are efficient in maintaining a cool temperature for the goods but they can be cumbersome to carry around to areas, such as picnics and camping.

Portable and flexible bag coolers are relatively recent way of providing portability to coolers as well as maintaining the cool temperature. Some examples of these cooler bags are disclosed in U.S. Pat. No. 5,472,279 (Lin), U.S. Pat. No. 4,826,060 (Hollingsworth), U.S. Pat. No. 6,068,402 (Freese et al), U.S. Pat. No. 5,490,396 (Morris), U.S. Pat. No. 4,537,313 (Workman) and Design U.S. Pat. No. 328,550 (Mogil et al). These examples all have a similar arrangement in that they have a foldable lid arranged to enclose the bag. The bags, as mentioned in the examples listed above, do not disclose a separate container for storing liquid or a removable liner for cleaning and such.

U.S. Pat. No. 4,802,344 (Livingston et al) discloses a bag for receive a keg arranged to maintain a cool temperature of the keg and to provide a suitable carrying means of the keg.

U.S. Pat. No. 5,403,095 (Melb) provides a portable cooler bag having a removable rigid liner arranged to provide rigidity to the bag. This cooler although providing a portable bag can face the same problems as the common rigid containers mentioned above.

U.S. Pat. No. 5,447,256 (Graham) provides a container which is arranged to hold a fluid container having a retractable drip tray. This example is not a portable unit and can be difficult to carry. This example is arranged to be a stationary dispenser for a liquid positioned in areas such as cafeterias and the like.

SUMMARY

According to the present invention there is provided a cooler comprising:

a container having a container bottom wall and upstanding side walls standing upwardly from a periphery of the bottom wall and defining an open top;

a cover wall hingedly connected to one of the side walls and attachable to at least one other of the side walls so as to close the open top;

each of the side walls and the cover wall being formed of a flexible fabric material with a layer of insulating material thereon such that the side walls can be folded to allow collapse of the container from an expanded position for receiving articles to be maintained cooled to a collapsed storage condition;

a bottle for receiving liquid arranged such that contents of the bottle can be frozen or cooled to provide cooling to material in the container;

the bottle having two opposed side walls and a peripheral wall with one side wall shaped to substantially match the shape of the bottom wall such that the bottle is arranged to be located at the bottom of the container with the side wall lying against the bottom wall to provide stiffening for the bottom wall and the other side wall facing into the interior of the container;

the bottle having a bottle neck extending through the peripheral wall through which the liquid can be poured into and discharged from the bottle;

and a closure cap covering the bottle neck the bottle neck and the closure cap being arranged so as to be accessible at one side wall of the container for discharge of the liquid.

Preferably the bottom wall includes an insulating layer so as to maintain the bottle separated from the exterior.

Preferably one side wall includes an opening shaped to match the bottle neck.

Preferably the bottle and the container are arranged such that the bottle is removable from the container for placement separately in a cooler for cooling contents of the bottle.

Conveniently the container is arranged such that the bottle can be removed through the open top.

Conveniently the container includes a water proof liner which extends over the side walls and over the bottle and which can be moved to allow the bottle to be removed through the open top.

Conveniently the water proof liner is attached to the container around the open top and can be separated therefrom at least at one side to allow the bottle to be removed.

Conveniently the container is arranged such that the bottle is removed through one side wall.

Conveniently the side wall includes an openable cover which can be opened to allow the bottle to be removed.

Preferably the container includes a water proof liner covering the side walls and over the bottle.

Preferably the closure cap includes a manually operable faucet allowing controlled dispensing of the liquid through the side wall while the bottle remains in the container.

Preferably the side walls of the bottle are parallel and co-extensive.

BRIEF DESCRIPTION OF THE DRAWINGS

In the accompanying drawings, which illustrate an exemplary embodiment of the present invention.

DETAILED DESCRIPTION

Figure 1:
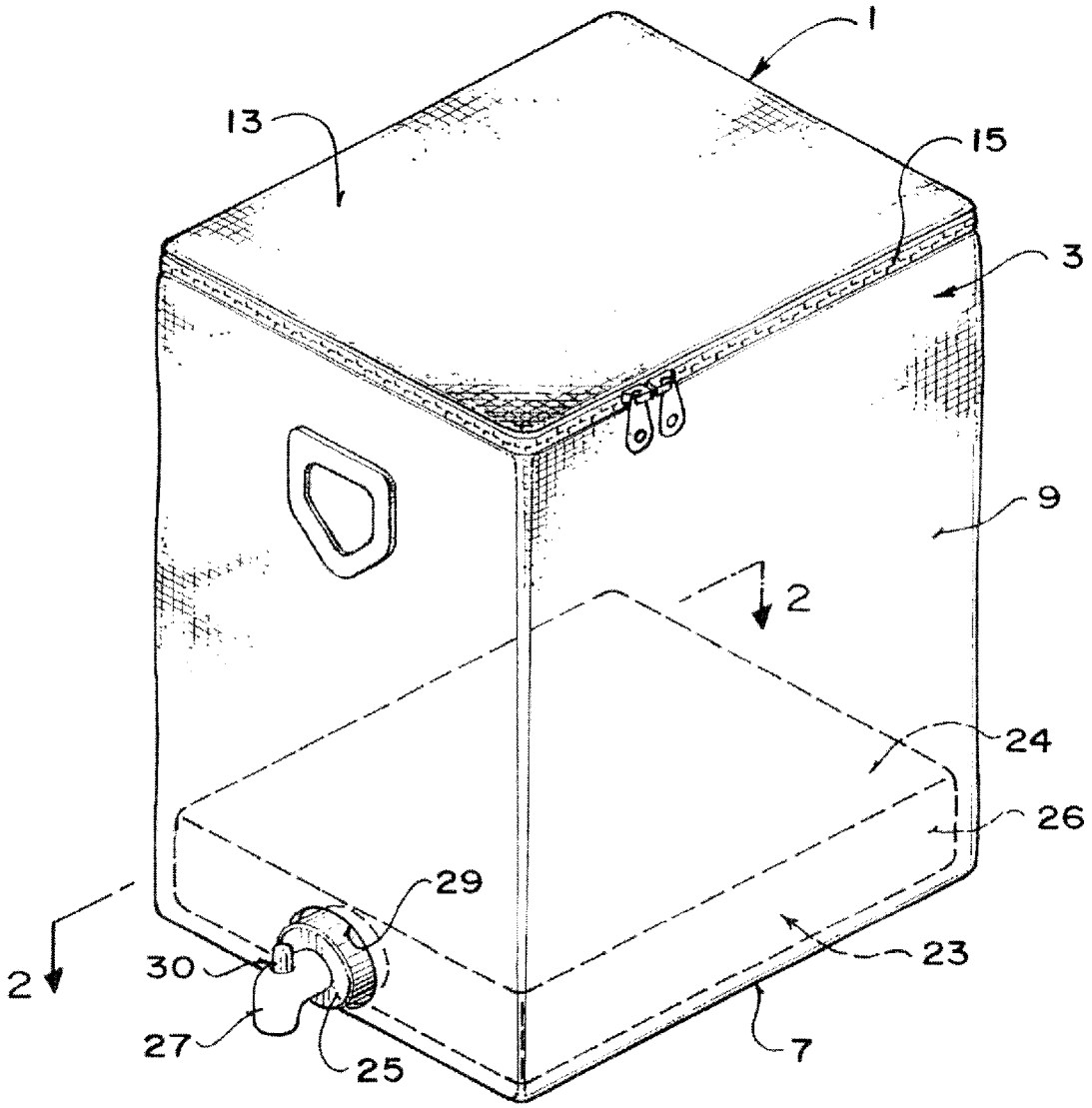
FIG. 1 is an isometric view of the present invention.
Figure 2:
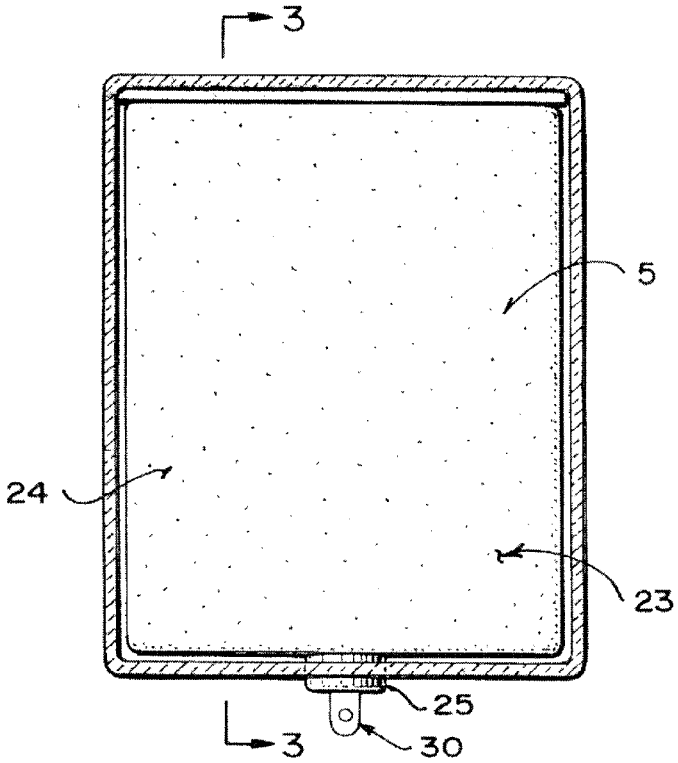
FIG. 2 is a horizontal cross section along the lines 2—2 of FIG. 1.
Figure 5:
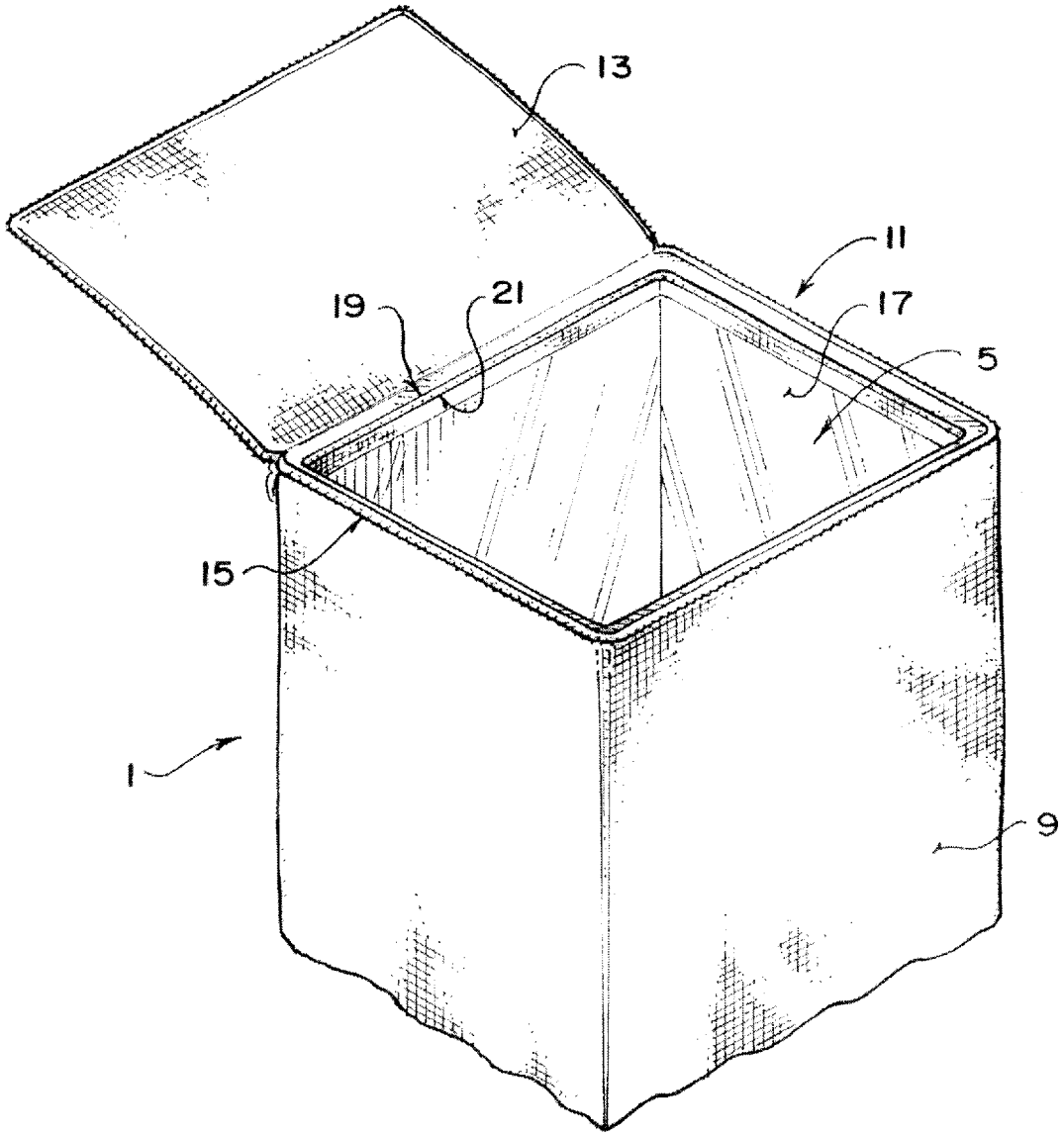
FIG. 5 is an isometric view of the present invention shown the interior of the present invention.

As illustrated in FIG. 1, a cooler 1 is arranged to contain goods such as drinks or food at a cool temperature. The cooler has an insulated container 3 enclosing an interior 5 wherein the good are placed. The container has a bottom wall 7 and upstanding side walls 9 standing upwardly from a periphery of the bottom wall and defining an open top 11. The walls are insulated to keep the cool temperature within the container. A cover 13 is hinged to a side wall and has a zipper 15 about the open top for enclosing the container. The cover is arranged to open and close for providing access to the interior. Side walls and the cover are a flexible fabric material such that the side walls can be folded to allow collapse of the container from an expanded position, for receiving the goods to be maintained cooled, to a collapsed storage condition. The container has a waterproof liner 17, as best shown in FIG. 5. The water proof liner is positioned in the interior of the container and is removable therefrom. The liner has an attachable top end 19 which is arranged to attach to a corresponding top portion 21 in the interior. The means for attaching the liner is preferably Velcro™ which extends about the perimeter of the interior. The liner is the same size and shape of the interior. The liner can easily be cleaned of spilled or leaked goods by removing the liner and washing. This eliminates the need to clean the entire cooler.

The bottom end of the container is arranged to receive a bottle 23. The bottle has two opposed side walls 24 and a peripheral wall 26 with one side all shaped to substantially match the shape of the bottom wall of the container. The shape of the bottom is arranged to be located at the bottom of the container with the side wall lying against the bottom wall to provide stiffening for the bottom wall and the other side wall facing into the interior of the container. The bottle is arranged to receive a liquid. The bottle has a neck 25 which extends through the peripheral wall through which the liquid can be poured into and discharged from the bottle. A nozzle 27 is arranged to be attached to the neck. The nozzle controls the liquid within the bottle thereby allowing a user to pour the liquid from the bottle. The bottle neck and nozzle are arranged to be accessible at one side wall of the container for discharging of the liquid. The neck and nozzle extend through an exit 29 located at the bottom end of one of the side walls. The nozzle has a manually operable faucet 30 allowing controlled dispensing of the liquid through the side all while the bottle remains in the container. The side walls of the bottle are parallel and co-extensive.

Figure 3:
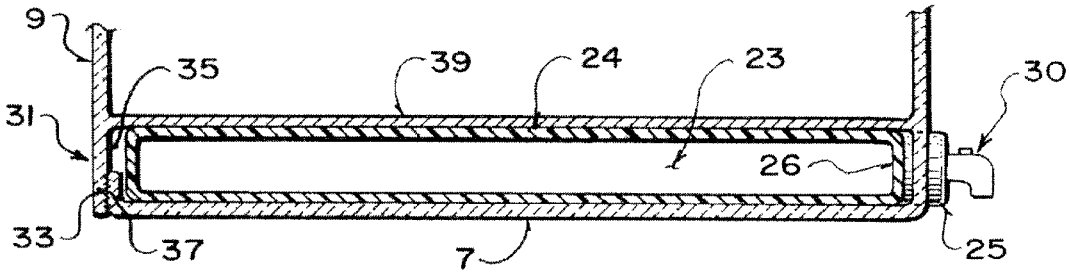
FIG. 3 is a vertical cross section along the lines 3—3 of FIG. 2 showing one arrangement of the present invention.

In one embodiment, illustrated in FIG. 3, the bottom end has a closable opening 31 at one end so that the bottle can be removed therethrough. The opening has a Velcro™ flap 33 extending from either the top edge or bottom edge of the opening arranged to receive a enclosure portion 35. The enclosure portion has a corresponding Velcro™ portion 37 which connects to the flap. The embodiment of the container shown in FIG. 3, has an intermediate wall 39 located above the bottle arranged to separate the goods within the container and the bottle. The intermediate wall is not insulated thereby providing the cool temperature from the bottle and/or container to maintain the cool temperature respectively.

Figure 4:
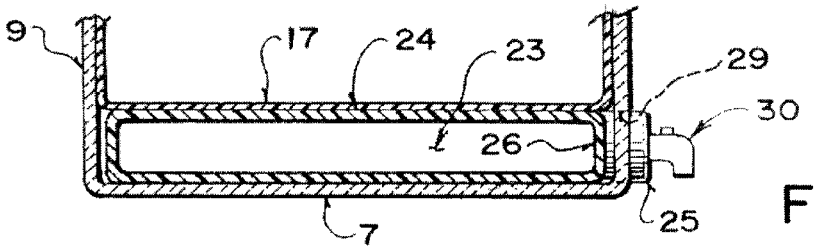
FIG. 4 is a vertical cross section along the lines 3—3 of FIG. 2 shown another arrangement of the present invention.

In a second embodiment, the bottle is arranged to be removable from the container such that the bottle can be filled with the liquid. The bottle can be replaced and removed through the open end of the container such that the nozzle extends through the exit, as best shown in FIG. 4. The exit is shaped to match the bottle neck. The water proof liner is arranged to fit above the bottle when in the container.

The bottle can be filled with a drinkable liquid such as water and then frozen to provide cooling. The melted or unfrozen liquid in the container can be dispensed from the bottle for a cool drink. The cooler is also provided with hooks arranged to receive a strap or the like for carrying the cooler. Additional cooling can be provided by separate cooling elements frozen and located in the container above the bottle, or in an alternative mode of use, the primary cooling can be provided by the separate cooling elements which act to cause cooling of liquid in the bottle.

While one embodiment of the present invention has been described in the foregoing, it is to be understood that other embodiments are possible within the scope of the invention. The invention is to be considered limited solely by the scope of the appended claims.

What is claimed is:

1. A cooler comprising:

a container having a container bottom wall and upstanding side walls standing upwardly from a periphery of the bottom wall and defining an open top;

a cover wall hingedly connected to one of the side walls and attachable to at least one other of the side walls so as to close the open top;

each of the side walls and the cover wall being formed of a flexible fabric material with a layer of insulating material thereon such that the side walls can be folded to allow collapse of the container from an expanded position for receiving articles to be maintained cooled to a collapsed storage condition;

a bottle for receiving liquid arranged such that contents of the bottle can be frozen or cooled to provide cooling to material in the container;

the bottle having two opposed side walls and a peripheral wall with one side wall shaped to substantially match the shape of the bottom wall such that the bottle is located at the bottom of the container with the side wall lying within the container and against the bottom wall to provide stiffening for the bottom wall and the other side wall facing into the interior of the container;

the bottle having a bottle neck extending from the bottle within the peripheral wall through the peripheral wall to an open mouth exposed outside the peripheral wall through which the liquid can be poured into and discharged from the bottle;

and a closure cap covering the bottle neck;

the bottle neck and the closure cap being arranged so as to be accessible at one side wall of the container for discharge of the liquid;

wherein the bottle and the container are arranged such that the bottle is separate from and removable from the container for placement separately in a cooler for cooling contents of the bottle.

2. The cooler according to claim 1 wherein the bottom wall includes an insulating layer so as to maintain the bottle separated from the exterior.

3. The cooler according to claim 1 wherein said one side wall includes an opening shaped to match the bottle neck.

4. A cooler comprising:

a container having a container bottom wall and upstanding side walls standing upwardly from a periphery of the bottom wall and defining an open top;

a cover wall hingedly connected to one of the side walls and attachable to at least one other of the side walls so as to close the open top;

each of the side walls and the cover wall being formed of a flexible fabric material with a layer of insulating material thereon such that the side walls can be folded to allow collapse of the container from an expanded position for receiving articles to be maintained cooled to a collapsed storage condition;

a bottle for receiving liquid arranged such that contents of the bottle can be frozen or cooled to provide cooling to material in the container;

the bottle having two opposed side walls and a peripheral wall with one side wall shaped to substantially match the shape of the bottom wall such that the bottle is located at the bottom of the container with the side wall lying within the container and against the bottom wall to provide stiffening for the bottom wall and the other side wall facing into the interior of the container;

the bottle having a bottle neck extending from the bottle within the peripheral wall through the peripheral wall to an open mouth exposed outside the peripheral wall through which the liquid can be poured into and discharged from the bottle;

and a closure cap covering the bottle neck;

the bottle neck and the closure cap being arranged so as to be accessible at one side wall of the container for discharge of the liquid;

wherein the bottle and the container are arranged such that the bottle is separate from the container removable from the container for placement separately in a cooler for cooling contents of the bottle wherein the container is arranged with the bottle at the bottom wall being accessible from the open top such that the bottle is removable through the open top.

5. The cooler according to claim 4 wherein the container includes a water proof liner which extends over the side walls and over the bottle and which can be moved to allow the bottle to be removed through the open top.

6. The cooler according to claim 5 wherein the water proof liner is attached to the container around the open top and can be separated therefrom at least at one side to allow the bottle to be removed.

7. A cooler comprising a container having a container bottom wall and upstanding side walls standing upwardly from a periphery of the bottom wall and defining an open top;

a cover wall hingedly connected to one of the side walls and attachable to at least one other of the side walls so as to close the open top;

each of the side walls and the cover wall being formed of a flexible fabric material with a layer of insulating material thereon such that the side walls can be folded to allow collapse of the container from an expanded position for receiving articles to be maintained cooled to a collapsed storage condition;

a bottle for receiving liquid arranged such that contents of the bottle can be frozen or cooled to provide cooling to material in the container;

the bottle having two opposed side walls and a peripheral wall with one side wall shaped to substantially match the shape of the bottom wall such that the bottle is located at the bottom of the container with the side wall lying within the container and against the bottom wall to provide stiffening for the bottom wall and the other side wall facing into the interior of the container;

the bottle having a bottle neck extending from the bottle within the peripheral wall through the peripheral wall to an open mouth exposed outside the peripheral wall through which the liquid can be poured into and discharged from the bottle;

and a closure cap covering the bottle neck;

the bottle neck and the closure cap being arranged so as to be accessible at one side wall of the container for discharge of the liquid;

wherein the bottle and the container are arranged such that the bottle is separate from the container removable from the container for placement separately in a cooler for cooling contents of the bottle wherein the side wall includes an opening therein shaped to allow the bottle to pass through the opening and an openable cover over the opening which can be opened to allow the bottle to be removed.

8. The cooler according to claim 7 wherein the container includes water proof liner covering the side walls and over the bottle.

9. The cooler according to claim 1 wherein the closure cap includes a manually operable faucet allowing controlled dispensing of the liquid through the side wall while the bottle remains in the container.

10. The cooler according to claim 1 wherein the side walls of the bottle are parallel and co-extensive.

11. The cooler according to claim 4 wherein the closure cap includes a manually operable faucet allowing controlled dispensing of the liquid through the side wall while the bottle remains in the container.

12. The cooler according to claim 4 wherein the side walls of the bottle are parallel and co-extensive.

13. The cooler according to claim 4 wherein the bottom wall includes an insulating layer so as to maintain the bottle separated from the exterior.

14. The cooler according to claim 4 wherein said one side wall includes an opening shaped to match the bottle neck.

15. The cooler according to claim 7 wherein the closure cap includes a manually operable faucet allowing controlled dispensing of the liquid through the side wall while the bottle remains in the container.

16. The cooler according to claim 7 wherein the side walls of the bottle are parallel and co-extensive.

17. The cooler according to claim 7 wherein the bottom wall includes an insulating layer so as to maintain the bottle separated from the exterior.

18. The cooler according to claim 7 wherein said one side wall includes an opening shaped to match the bottle neck.

* * * * *